US007959694B2

(12) United States Patent
Braunschweig et al.

(10) Patent No.: US 7,959,694 B2
(45) Date of Patent: Jun. 14, 2011

(54) LASER CUT ABRASIVE ARTICLE, AND METHODS

(75) Inventors: Ehrich J. Braunschweig, Woodbury, MN (US); Rufus C. Sanders, Burnsville, MN (US); Charles J. Studiner, IV, Cottage Grove, MN (US); Edward J. Woo, Woodbury, MN (US)

(73) Assignee: 3m Innovative Properties Company, St. Paul, MN (US)

( * ) Notice: Subject to any disclaimer, the term of this patent is extended or adjusted under 35 U.S.C. 154(b) by 882 days.

(21) Appl. No.: 11/781,573

(22) Filed: Jul. 23, 2007

(65) Prior Publication Data

US 2008/0216414 A1 Sep. 11, 2008

Related U.S. Application Data

(60) Provisional application No. 60/893,003, filed on Mar. 5, 2007.

(51) Int. Cl.

| | |
|---|---|
| ***C09K 3/14*** | (2006.01) |
| ***B24D 3/02*** | (2006.01) |
| ***C09C 1/68*** | (2006.01) |
| ***B24B 1/00*** | (2006.01) |

(52) U.S. Cl. ..... 51/298; 51/307; 451/36

(58) Field of Classification Search ..... 51/298, 51/307; 428/144; 451/530, 533, 36

See application file for complete search history.

(56) References Cited

U.S. PATENT DOCUMENTS

| | | | | |
|---|---|---|---|---|
| 2,307,312 | A | | 1/1943 | Whiting |
| 2,749,681 | A | | 6/1956 | Reidenbach |
| 3,866,304 | A | | 2/1975 | Hutchins |
| 4,311,489 | A | | 1/1982 | Kressner |
| 4,652,274 | A | | 3/1987 | Boettcher et al. |
| 4,652,275 | A | | 3/1987 | Bloecher et al. |
| 4,799,939 | A | | 1/1989 | Bloecher et al. |
| D325,774 | S | | 4/1992 | Manville et al. |
| 5,152,917 | A | | 10/1992 | Pieper et al. |
| 5,435,816 | A | | 7/1995 | Spurgeon et al. |
| 5,533,923 | A | * | 7/1996 | Shamouilian et al. ..... 451/41 |
| 5,549,962 | A | | 8/1996 | Holmes et al. |
| 5,578,343 | A | | 11/1996 | Gaeta et al. |
| 5,810,650 | A | | 9/1998 | Jöst |
| D460,767 | S | | 7/2002 | Kim et al. |
| 6,826,204 | B2 | | 11/2004 | Kennedy et al. |
| 7,025,663 | B2 | | 4/2006 | Kim |
| 7,040,973 | B1 | | 5/2006 | Kitts |
| D532,800 | S | | 11/2006 | Braunschweig et al. |
| 7,150,677 | B2 | | 12/2006 | Yamashita et al. |
| D536,714 | S | | 2/2007 | Braunschweig et al. |
| D538,312 | S | | 3/2007 | Braunschweig et al. |
| D541,317 | S | | 4/2007 | Braunschweig et al. |

(Continued)

FOREIGN PATENT DOCUMENTS

| | | |
|---|---|---|
| WO | WO 96/13358 | 5/1996 |

*Primary Examiner* — Anthony J Green
*Assistant Examiner* — Pegah Parvini
(74) *Attorney, Agent, or Firm* — Scott A. Baum

(57) ABSTRACT

Abrasive articles, and methods of making abrasive articles by using a laser to convert (e.g., cut) at least a portion of the abrasive coating to form the abrasive article. The method includes laser propagation impinging on the abrasive back side (opposite the abrasive coating) and progressing through to the abrasive side. Such a process inhibits ridging effects around cut regions (e.g., openings) on the front side.

8 Claims, 5 Drawing Sheets

U.S. PATENT DOCUMENTS

| | | | | |
|---|---|---|---|---|
| D543,562 | S | 5/2007 | Braunschweig et al. | |
| D550,819 | S | 9/2007 | Seehoff | |
| 2004/0072510 | A1 | 4/2004 | Kinoshita et al. | |
| 2005/0130568 | A1 | 6/2005 | Welygan et al. | |
| 2006/0135050 | A1 | 6/2006 | Petersen et al. | |
| 2006/0160481 | A1 | 7/2006 | Miyanaga | |
| 2007/0028526 | A1 | 2/2007 | Woo et al. | |
| 2007/0037500 | A1* | 2/2007 | Minick et al. | 451/533 |
| 2007/0066198 | A1* | 3/2007 | Rambosek et al. | 451/533 |
| 2007/0099552 | A1 | 5/2007 | Chen et al. | |
| 2008/0081546 | A1 | 4/2008 | Takinami et al. | |
| 2008/0216413 | A1 | 9/2008 | Woo et al. | |

* cited by examiner

LASER CUT ABRASIVE ARTICLE, AND METHODS

CROSS-REFERENCE TO RELATED APPLICATION

This application claims the benefit of U.S. Provisional Patent Application having Ser. No. 60/893,003 filed Mar. 5, 2007 entitled Laser Cut Abrasive Article, and Methods, the entire disclosure which is incorporated herein.

TECHNICAL FIELD

This disclosure relates to abrasive articles, methods of making such abrasive articles and methods of using such abrasive articles.

BACKGROUND

Abrasive articles have been used to abrade and finish workpiece surfaces for well over a hundred years. These applications have ranged from high stock removal from workpieces such as wood and metal, to fine polishing of ophthalmic lenses, fiber optics and computer read/write heads. In general abrasive articles comprise a plurality of abrasive particles bonded either together (e.g., a bonded abrasive of grinding wheel) or to a backing (e.g., a coated abrasive). For a coated abrasive there is typically a single layer, or sometimes a plurality of layers, of abrasive particles bonded to the backing. The abrasive particles may be bonded to the backing with a "make" and "size" coat, or as a slurry coat.

Various configurations of abrasive articles are known, for example, discs, endless belts, sanding sponges, and the like. The configurations of the abrasive article will affect the intended use of the articles. For example, some abrasive articles are configured to be connected to a vacuum source during use, to remove dust and swarf from the abrading surface.

For generally all coated abrasive articles, in use, the exposed tips of the abrasive particles abrade the workpiece. New particle surfaces are continuously being exposed to extend the life of the abrasive article. After a certain time, when the abrasive article no longer has a sufficient amount of decent abrading surfaces left, the coated abrasive is essentially worn out and is typically discarded.

Although coated abrasive articles have been known for over a hundred years, there are always improvements being made to the articles and to the methods of making the abrasive articles.

SUMMARY

The present disclosure is directed to methods of making abrasive articles using a laser to convert (e.g., cut) at least a portion of the abrasive coating to form the abrasive article. The method includes impinging focused laser energy on the back side of the abrasive article (opposite the abrasive coating), the laser energy progressing through to the face side. Such a process reduces the amount of ridging effects (also known as "recast") from polymer components of the abrasive article around cut regions (e.g., openings) on the front side.

In one particular aspect, this disclosure is directed to a method of making an abrasive article comprising providing an abrasive coating on a first side of a backing, the backing also having a second side, and passing focused laser energy through the backing, with the laser energy passing through the second side of the backing prior to passing through the abrasive coating. The laser may form an internal aperture in the abrasive coating or a plurality of internal apertures in the abrasive coating. In some embodiments, the laser forms at least 10 internal apertures in the abrasive coating, at least 40 or 50, or at least 100 internal apertures in the abrasive coating. In some embodiments, the laser additionally or alternatively forms an outer perimeter of the abrasive coating.

In another particular aspect, this disclosure is directed to an abrasive article that has an abrasive coating on a first side of a backing, the abrasive coating comprising abrasive particles less than 40 micrometers, and at least one aperture through the backing and the abrasive coating. The sidewall of the aperture is fused, and extends no more than 10 micrometers above the abrasive coating.

The backing of the abrasive article maybe a polymeric backing (e.g., thermoplastic or thermoset backing), a paper backing, a cloth backing, or the like. Laminated backings, having a plurality of layers, optionally held together by adhesive or otherwise, may be used. The abrasive coating may be a make/size abrasive coating, a slurry coating, or a shaped abrasive coating comprising composites, such as precisely shaped composites.

These and various other features which characterize the articles and methods of this disclosure are pointed out with particularity in the attached claims. For a better understanding of the articles and methods of the disclosure, their advantages, their use and objectives obtained by their use, reference should be made to the drawings and to the accompanying description, in which there is illustrated and described preferred embodiments of the invention of this disclosure.

DETAILED DESCRIPTION

The present disclosure provides an abrasive article having an abrasive coating (having a plurality of abrasive particles) bonded to a first side of a backing. A supersize coating may be present over the abrasive coating and optionally over any exposed surfaces of the backing. This disclosure also provides methods of making an abrasive article and methods of using that article. The methods of making the abrasive article include using a laser to cut through the backing and the abrasive coating, providing cuts that are generally fused, e.g., having generally smooth surfaces, free of asperities, having resolidified melted regions, and that may be glossy. Fused cuts have no mechanical defects, such as crushed or broken abrasive coating components or frayed backing edges. The laser is used in a manner so that the side of the abrasive article free of abrasive coating is cut first by the laser; i.e., the laser energy is focused on the side of the abrasive article free of abrasive coating. The cuts made by the laser may be internal cuts in the abrasive article.

Figure 1:
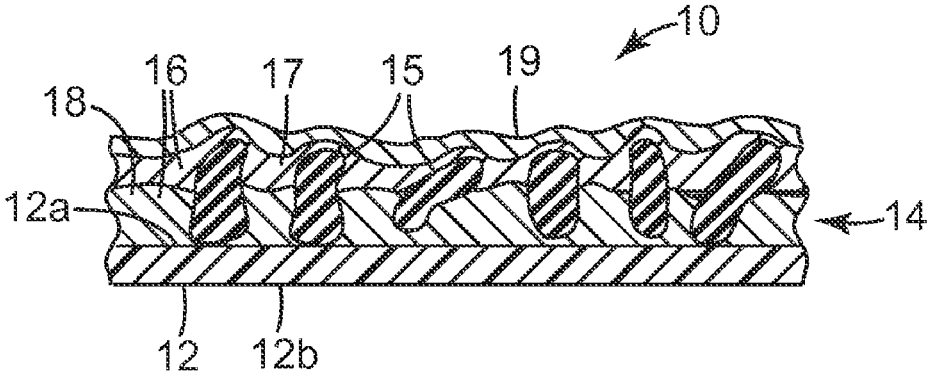
FIG. 1 is a schematic cross-sectional side view of a first embodiment of a coated abrasive article.

In FIG. 1, a first embodiment of an abrasive article is illustrated as abrasive article 10. Abrasive article 10 is commonly referred to as a "coated abrasive article", having a plurality of abrasive particles bonded to a backing. This abrasive article 10 has a backing 12, having a first side 12*a* and an opposite second side 12*b*. An abrasive coating 14 is present on the first side 12*a* of backing 12.

Abrasive coating 14, in this embodiment, comprises a plurality of abrasive particles 15 retained by an adhesive matrix 16. This adhesive matrix 16 comprises a make coat 18, into which abrasive particles 15 are at least partially embedded, and an overlying size coat 17. Abrasive particles 15 are typically oriented in make coat 18, for example by application of an electrostatic field to the particles as they are applied.

This embodiment of abrasive article 10 includes a supersize coat 19, present over size coal 17. A supersize coat or layer, if present, is a coating applied on at least a portion of the size layer, and is generally added to provide, for example, a grinding aid, and/or as an anti-loading coating. Further, optional supersize layer 19 may prevent or reduce the accumulation of swarf (the material abraded from a workpiece) on size coat 17 or between abrasive particles 15, and/or in and around apertures 45 (discussed below in respect to FIG. 4*a*), which can dramatically reduce the cutting ability and/or the resulting workpiece finish provided by abrasive article 10. Useful supersize layers 19 include a grinding aid (e.g., potassium tetrafluoroborate) or metal salts of fatty acids (e.g., zinc stearate or calcium stearate). Other materials may be present in supersize layer 19.

In some embodiments, supersize layer 19 is applied over size coat 17 after conversion (e.g., by laser) of the abrasive article. Application of supersize layer 19 after conversion, either by non-contact processes (such as by laser conversion) or by contact processes (such as mechanical die cutting), covers newly created or fresh surfaces, including, for example, newly-exposed sidewalls of the abrasive article or aperture(s) therein. Application of supersize layer 19 after converting (cutting) the abrasive article covers the cut surfaces and generally increases the life and/or cut rate of the abrasive article and reduces the scratching caused by exposed surfaces.

Abrasive article 10 is a generic example of an abrasive article having a make/size adhesive matrix. It is understood that alternate configurations of abrasive articles are possible without falling out of the scope of a make/size abrasive articles.

Figure 2:
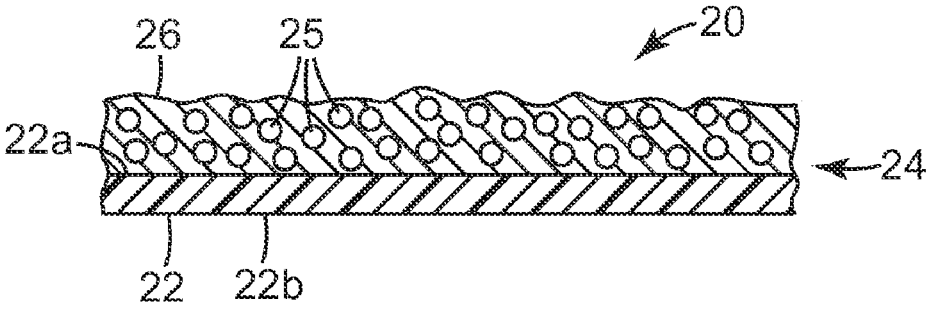
FIG. 2 is a schematic cross-sectional side view of a second embodiment of a coated abrasive article.

In FIG. 2, a second embodiment of an abrasive article is illustrated as abrasive article 20. Abrasive article 20 is commonly referred to as a "coated abrasive article", having a plurality of abrasive particles bonded to a backing. This abrasive article 20 has a backing 22, having a first side 22*a* and an opposite second side 22*b*. An abrasive coating 24 is present on the first side 22*a* of backing 22. Although not illustrated, a supersize layer or coating could be present over at least a portion of abrasive coating 24.

Abrasive coating 24, in this embodiment, comprises a plurality of abrasive particles 25 retained by and distributed through an adhesive matrix 26. Abrasive article 20 is an example of a slurry coating abrasive article.

Figure 3:
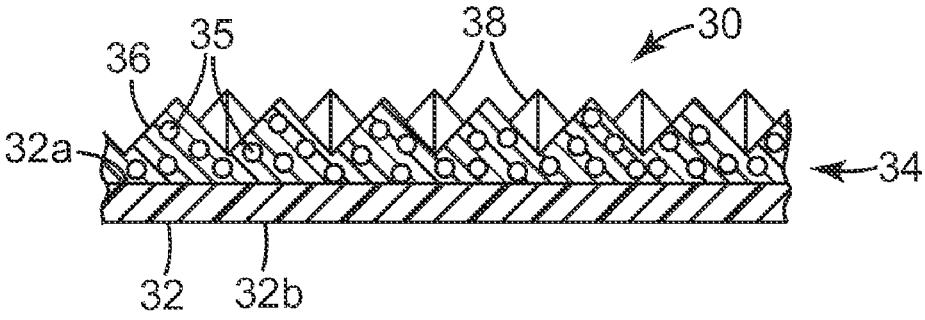
FIG. 3 is a schematic cross-sectional side view of a third embodiment of a coated abrasive article.

In FIG. 3, a third embodiment of an abrasive article is illustrated as abrasive article 30. Abrasive article 30 is commonly referred to as a "shaped abrasive article", having a plurality of abrasive particles bonded to a backing. This abrasive article 30 has a backing 32, having a first side 32*a* and an opposite second side 32*b*. An abrasive coating 34 is present on the first side 32*a* of backing 32. Although not illustrated, a supersize layer or coating could be present over at least a portion of abrasive coating 34.

Abrasive coating 34, in this embodiment, comprises a plurality of abrasive composites 38, which are composites of abrasive particles 35 distributed in an adhesive matrix 36. Abrasive composites 38 are separated by a boundary or boundaries associated with the composite shape, resulting in one abrasive composite 38 being separated to some degree from another adjacent abrasive composite 38. If the boundaries are precise, abrasive composites 38 can be referred to as "precisely shaped composites". One of the earliest references to abrasive articles with precisely shaped abrasive composites is U.S. Pat. No. 5,152,917 to Pieper et al. Many others have followed.

Backing

As mentioned above, a coated abrasive article has a backing onto which the abrasive coating is applied. The backing has a front surface (e.g., side 12*a*) and back surface (e.g., side 12*b*) and can be any abrasive backing. Examples of suitable backings include polymeric film including primed polymeric film, cloth, paper, vulcanized fiber, thermoplastic backings, nonwovens, and combinations thereof. Multiple layer backings may be used, as desired. Multiple layer backings may be laminates of one or more known backing materials, usually with an adhesive to hold the layers together. Fibrous reinforcement may be added within or on the surface of any of these materials. For some abrasive articles, metal is a suitable backing material.

The backing may also contain a treatment or treatments to seal the backing and/or modify some physical property of the backing. These treatments are well known in the art.

The backing may include an attachment system on its back surface to enable securing the resulting coated abrasive to a support pad or back-up pad. This attachment system can be a pressure sensitive adhesive, one surface of a hook and loop attachment system, an intermeshing attachment system, or a threaded projection. The backside (e.g., side 12*b*) of the abrasive article may also contain a slip resistant or frictional coating. Examples of such coatings include inorganic particulate (e.g., calcium carbonate or quartz) dispersed in an adhesive.

Abrasive Coating

Abrasive Particles

The abrasive particles (e.g., abrasive particles 15) typically have a particle size ranging from about 0.1 to 1500 micrometers, usually between about 0.1 to 400 micrometers. In some embodiments, the size is between 0.1 to 100 micrometers and in other embodiments between 0.1 to 40 micrometers. Laser converting, in accordance with this disclosure, is particularly beneficial for abrasive coatings that utilize abrasive particles having a particle size of less than about 40 micrometers.

Abrasive particles have a Mohs' hardness of at least about 8, and usually at least 9. Examples of usual abrasive particles include fused aluminum oxide (which includes brown aluminum oxide, heat treated aluminum oxide and white aluminum oxide), ceramic aluminum oxide, green silicon carbide, silicon carbide, chromia, alumina zirconia, diamond, iron oxide, ceria, cubic boron nitride (CBN), boron carbide, garnet and combinations thereof.

The term "abrasive particle" also encompasses when single abrasive particles are bonded together to form an abrasive agglomerate. Abrasive agglomerates are described in U.S. Pat. Nos. 4,311,489; 4,652,275 and 4,799,939; precisely shaped abrasive agglomerates are described in U.S. Pat. No. 5,549,962.

The abrasive particles may include a surface coating, for example, to increase adhesion of abrasive particles to the adhesive matrix, to alter the abrading characteristics of the abrasive particle, or the like. Examples of surface coatings include coupling agents, halide salts, metal oxides including silica, refractory metal nitrides, refractory metal carbides and the like.

The abrasive article may include diluent particles, which are not abrasive particles. The particle size of these diluent particles may be on the same order of magnitude as the abrasive particles. Examples of such diluent particles include gypsum, marble, limestone, flint, silica, glass bubbles, glass beads, aluminum silicate, and the like.

Adhesive Matrix

The abrasive particles are adhered with a binder to form the abrasive article. For most coated abrasive articles, the binder is an organic or polymeric binder, and is derived from a binder precursor. During the manufacture of coated abrasive articles, the binder precursor is exposed to an energy source which aids in the initiation of the polymerization or curing of the binder precursor.

Examples of energy sources include thermal energy and radiation energy, the latter including electron beam, ultraviolet light, and visible light. During this polymerization process, the binder precursor is polymerized or cured and is converted into a solidified binder. Upon solidification of the binder precursor, the adhesive matrix is formed.

Examples of typical and preferred organic resins for use in coated abrasive articles include phenolic resins, urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and mixtures and combinations thereof. The term "acrylate" encompasses acrylates and methacrylates.

Phenolic resins are widely used in abrasive article binders because of their thermal properties, availability, and cost. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one.

Acrylated urethanes are diacrylate esters of hydroxy-terminated, isocyanate extended polyesters or polyethers.

Acrylated epoxies are diacrylate esters of epoxy resins, such as the diacrylate esters of bisphenol A epoxy resin.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyloxyethyl)isocyanurate, 1,3,5-tri(2-methyacryloxyethyl)-triazine, acrylamide, methylacrylamide, N-methylacrylamide, N,N-dimethylacrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof.

Isocyanurate derivatives having at least one pendant acrylate group and isocyanate derivatives having at least one pendant acrylate group are further described in U.S. Pat. No. 4,652,274. A preferred isocyanurate material is a triacrylate of tris(hydroxy ethyl)isocyanurate.

Epoxy resins have an oxirane and are polymerized by the ring opening. Such epoxide resins include monomeric epoxy resins and oligomeric epoxy resins. Examples of epoxy resins include 2,2-bis[4-(2,3-epoxypropoxy)-phenyl propane] (diglycidyl ether of bisphenol) and glycidyl ethers of phenol formaldehyde novolac.

If a tree radical curable resin is used, also generally included is a free radical curing agent or initiator. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimdazoles, bisimidazoles, chloroalkytriazines, benzoin ethers, benzil ketals, thioxanthones, and acetophenone derivatives, and mixtures thereof.

Method of Making Coated Abrasive Articles

The coated abrasive articles of this disclosure can be made by known coating processes.

Abrasive articles having make/size coats, such as abrasive article 10 of FIG. 1, are made by applying a make coat precursor to the backing, depositing a plurality of abrasive particles onto the make coat, optionally at least partially curing the make coat precursor, applying a size coat precursor over the abrasive particles, and then curing the size coat precursor to form the size coat. Methods of making abrasive articles having make/size coats are well known.

Slurry coated abrasive articles, such as abrasive article 20 of FIG. 2, are made by forming a slurry of binder precursor material and abrasive particles. The slurry is applied to the backing, and the binder precursor material is cured. Methods of making slurry coated abrasive articles are well known.

Shaped coated abrasive articles, such as abrasive article 30 of FIG. 3, are made by forming a slurry of binder precursor material and abrasive particles and then applying the slurry to a tool. The fool typically has a plurality of cavities, which are the negative of the desired resulting composites. The slurry, while in the cavities, is brought into contact with the backing. The binder precursor material is cured and the tool is removed from the composites. Methods of making such coated abrasive articles are well known. U.S. Pat. No, 5,152,917 describes various methods for making such precisely shaped abrasive articles, as does U.S. Pat. No. 5,433,816, although other methods could be used.

The coated backings are then converted (e.g., cut, punched, slit, etc.) to form the abrasive articles.

Figure 4A:
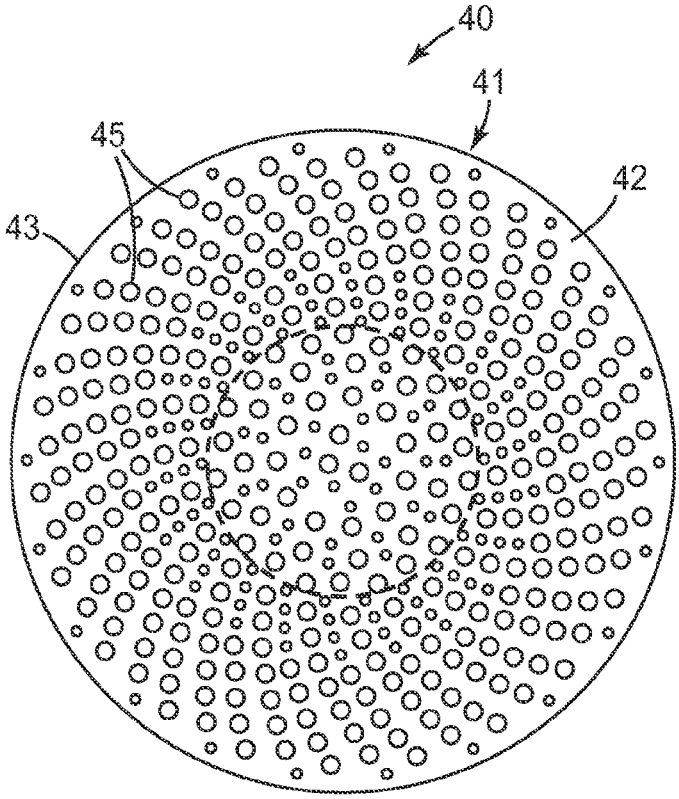
FIG. 4*a* is a schematic, top plan view of a coated abrasive article of the present disclosure.

In accordance with this disclosure, the abrasive articles are converted (e.g. cut, slit, formed, etc.) by a laser, or by laser energy. The laser may be used to form the overall shape of the abrasive article (i.e., form external cuts) or may be used to form internal features, such as apertures, in the abrasive article. FIG. 4*a* illustrates an apertured abrasive article 40 made in accordance with this disclosure.

As provided above, the backing of abrasive article 40 may include an attachment system or other coating on its back surface. This attachment system or other coating may be provided on the backing either before or after conversion by the laser.

An optional supersize coating, e.g., supersize coat 19 of FIG. 1, can be applied to abrasive article 40 before or after conversion by the laser. It has been found that if the supersize coating is applied to the abrasive article after converting with the laser, then generally no fresh surface (e.g., abrasive coating surface or backing) is exposed after application of the supersize coating. However, if the supersize coating is applied prior to laser converting, regions of the supersize coating proximate the laser energy may become distorted or damaged and fresh surfaces (e.g., abrasive coating or backing) are exposed. These exposed fresh surfaces have a tendency to collect swarf and/or create scratches. Applying the supersize coating after converting (e.g., laser converting) is especially beneficial for abrasive articles having internal apertures.

Returning to FIG. 4*a*, abrasive article 40 is specifically a disc 41 having an abrasive coating 42 on its front side. Although disc 41 is illustrated herein, it is understood that the invention of this disclosure is not limited to disc and similarly shaped abrasive articles 40, but that the invention of this disclosure can also be used with abrasive sheets, belts, wheels, pads, and other abrasive articles.

The front side of disc 41 corresponds to first side 12*a*, 22*a*, 32*a*, discussed above in relation to FIGS. 1, 2 and 3 and abrasive articles 10, 20, 30, respectively. Generally, the back side, which corresponds to second side 12*b*, 22*b*, 32*b*, does not have an abrasive coating thereon; in some embodiments, however, a friction-enhancing coating may be present on the back side. Abrasive coating 42 may be any one of abrasive coatings 14, 24, 34 described above, or may be yet another type of abrasive coating. Disc 41 has an outer perimeter 43 and a plurality of apertures 45 present in abrasive coating 42 and surrounded by perimeter 43. Apertures 45 pass through abrasive coating 42 and the backing on which coating 42 is present.

Disc 41 often has a diameter (defined by outer perimeter 43) of about 7.5 cm to 15 cm, although other sizes (both larger and smaller) and even shapes of abrasive articles can be made according to the methods of this disclosure. Apertures 45 often have a diameter of 1 mm to 30 mm.

Apertures 45 are common in certain abrasive articles. These apertures are commonly referred to as vent holes, ventilation holes, or dust holes. Apertures 45 often provide a self-cleaning of the abrasive article during use, apertures 45 providing passages for retainment and/or removal of dust (swarf) from the abrasive article—workpiece interface.

Disc 41 in FIG. 4*a* illustrates s plurality of apertures 45; other numbers and configurations of apertures 45 can be present, depending on the application for disc 41 and the size of disc 41. It is noted that although abrasive article 40 is a disc 41 and apertures 45 are circles, other shapes of abrasive articles 40 and/or apertures 45 can be made by the invention of this disclosure. For example, there may be fewer than 40 apertures, up to 50, up to 100, up to 200, or even greater than 500 apertures 45 in an abrasive article 40. Apertures 45 may have any placement within abrasive article 40, and they may occupy about 1% to about 50% open area, with individual openings of, for example, 1 mm, 10 mm, or even 30 mm in size.

Figure 4B:
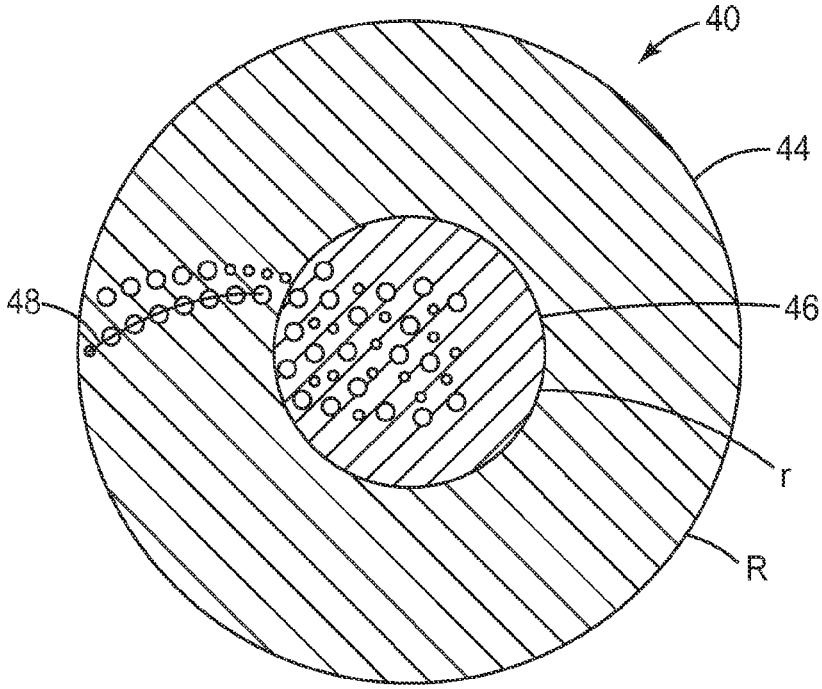
FIG. 4*b* is a schematic, top plan view of a coated abrasive article of the present disclosure.

In some embodiments, apertures 45 are arranged in a predetermined pattern. Examples of suitable patterns include random apertures 45, radial linearly disposed apertures 45, and concentric rings of apertures 45. Another example of a suitable pattern, illustrated in FIGS. 4*a* and 4*b*, is a series of apertures 45 at least partially arrayed in radially-disposed arcs and at least partially arrayed in a random pattern.

In this illustrated embodiment, abrasive article 40 (e.g., abrasive disc 41) is divided into two areas, and outer annular region and a central circular region. Referring to FIG, 4*b*, abrasive article 40 has an outer perimeter region 44, defined by radius R, and a central circular region 46, defined by radius r. Within central circular region 46, apertures 45 are oriented in a random pattern of different sized apertures. Within outer annular region 44, apertures 45 are positioned on radially-disposed arcs 48. The size and placement of apertures 45 alternates on each arc 48.

In accordance with this disclosure, at least one of outer perimeter 42 and apertures 45 is formed by a laser (e.g., cut with focused laser energy). A laser is particularly well suited for forming apertures 45 and provides cut surfaces that are fused. Fused cut surfaces are generally smooth surfaces, free of asperities, with resolidified melted regions, and that may be glossy. Fused cut surfaces have no mechanical defects, such as crushed or broken abrasive coating components or frayed backing edges.

The use of lasers for converting abrasive articles has been attempted prior to this application, however, the resulting abrasive articles have not been commercially or industrially acceptable. Prior to this application, the use of laser energy for processing (e.g., converting) abrasive articles resulted in problems such as thermal degradation, laser ridging, and surface related defects in the abrasive articles. These problems resulted in damaged and non-usable products with performance loss of 80% and greater, unacceptable poor finish characteristics, high numbers of, and quick formation rate of, major surface scratches (characterized by swirl marks) on the workpiece being finished.

Figure 6:
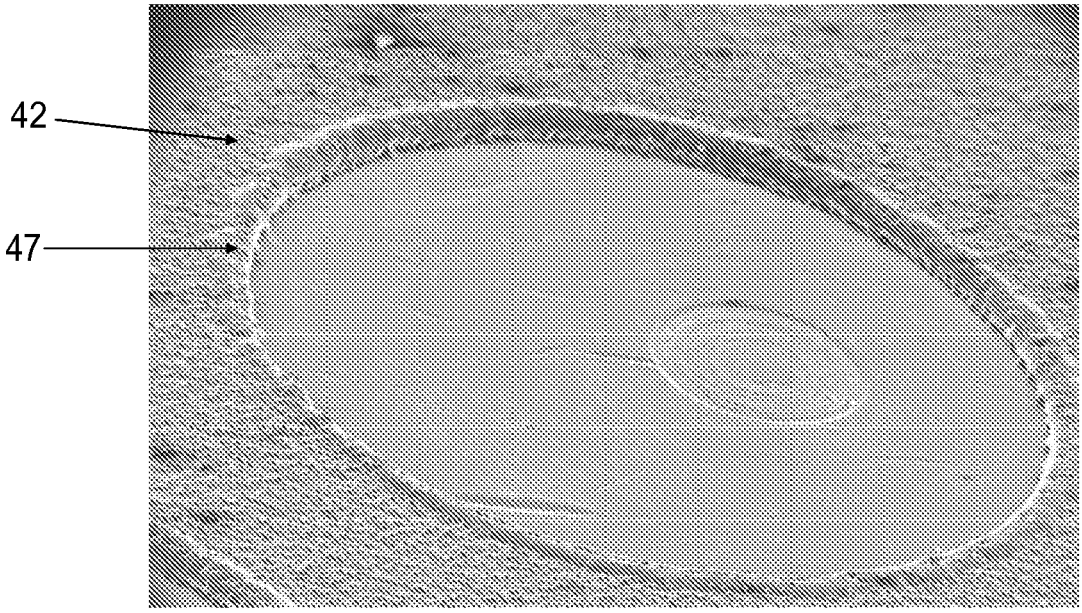
FIG. 6 is a close-up view of a photomicrograph of an internal aperture in an abrasive article, the internal aperture formed by a laser through the front side of the abrasive article.

Previously, laser cutting of abrasive articles left residual ridges proximate the laser cut edges, these ridges resulting from the flow and resolidification (recasting) of the material being cut (e.g., polymeric backing, abrasive coating, etc.). For example, FIG. 6 shows a prior-art laser-cut aperture in an abrasive article. The aperture has been successfully created in abrasive coating 42 and its underlying backing. However, a ridge or recast material 47 has formed. Such ridges are often at least 20 micrometers, and in some instances, at least 40 micrometers, higher than the adjacent abrasive coating 42. For abrasive articles with relatively few apertures 45 (e.g., less than about 10), or in relatively coarse grade abrasive articles (e.g., having abrasive particles greater than about 40 micrometers), these unintended ridges have little detrimental effect on the abrasive articles and their performance. However, as the number of apertures increases (e.g., greater than about 40), or when the abrasive particles decrease in size (e.g., less than about 40 micrometers, e.g., about 35 micrometers), the ridge artifacts inhibit abrasive performance, for example, by reducing abrasive cut due to lifting the abrasive surface from the workpiece and/or by causing undesirable scratches in the workpiece due to increased unit pressure at the ridges.

When lasers had been previously used to manufacture abrasive articles (e.g., abrasive article 40) with ventilation holes (e.g., apertures 45) that cover a portion of the working abrasive mineral surface (e.g., abrasive coating 42), problems with laser processing were of such a serious nature, that it has not been possible to use lasers in this function until now. The method of this disclosure provides products and processes that remedy the above mentioned problems and thereby achieve a high value final product for use by customers.

The method involves converting (e,g., cutting) an abrasive article with laser energy impingement initiating on the abrasive back side (i.e., the side opposite the abrasive coating) and progressing through to the face side (i.e., the abrasive coating side). In accordance with this disclosure, by cutting from the back to front, ridging effects around cut edges (particularly apertures 45) is avoided. If at all present, any ridge artifacts resulting from converting with a laser through the back to the front are no more than 10 micrometers in height, for example, 5 micrometers or less, or even 2 micrometers or less, above the abrasive coating.

Generally, "lasers"(i.e., "light amplification by stimulated emission of radiation") are sources of light, and specifically are forms of electromagnetic radiation which propagates at a velocity of $3\times10^{10}$ cm/s and are characterized by oscillating electric fields. The laser used for converting (e.g., perforating or cutting) the abrasive article may be any suitable conventional laser. Examples of suitable lasers include gas laser, chemical lasers, excimer lasers, and solid state lasers. While many laser types may be suitable for the converting of the abrasive articles described herein, low density gain media lasers such as a molecular gas lasers, known as a $CO_2$ lasers, are particularly useful and are preferred.

These gas lasers have many advantages. First, the gas used therein to generate laser light emissions is homogenous. In addition, the removal of heat, an important consideration in laser design, is relatively easy because the heated gas can flow out of the region where laser action occurs. As mentioned above, a preferable gas laser is a $CO_2$ laser, which is a molecular laser that operates on molecular energy levels and uses a mixture of carbon dioxide, nitrogen and helium. A $CO_2$ laser can either provide a continuous or pulsed laser emission. Operation of the carbon dioxide laser involves the excitation of vibrational levels of the nitrogen molecules by collisions with electrons in the electrical discharge, followed by resonant energy transfer to a vibrational level of the carbon dioxide molecules.

Examples of gas lasers include: carbon dioxide lasers, argon-ion lasers, carbon-monoxide lasers, and metal ion lasers, which are gas lasers that generate deep ultraviolet wavelengths, such as helium-silver (HeAg) 224 nm and neon-copper (NeCu) 248 nm lasers. These lasers have particularly narrow oscillation linewidths of less than 3 GHz (0.5 picometers).

Chemical lasers are powered by a chemical reaction, and can achieve high powers in continuous operation. For example, in the hydrogen fluoride laser (2700-2900 nm) and the deuterium fluoride laser (3800 nm), the reaction is the combination of hydrogen or deuterium gas with combustion products of ethylene in nitrogen trifluoride.

Another type of gas laser than can be used is an excimer layer. Excimer lasers represent laser technology in the ultraviolet portion of the light spectrum offering the capability of pulsed short-wavelength lasers having high peak power. A leading example of an excimer laser is the krypton fluoride laser.

Yet another type of laser is a high density gain media laser such as solid state laser or dye type lasers. These lasers represent laser technology which can span the infrared to the ultraviolet portion of the light spectrum, and also offer high peak power and high continuous power. One example of this type of laser is Nd:$YVO_4$ or neodymium-doped yttrium vanadate laser, and its shorter wavelength harmonics.

The $CO_2$ laser, particularly at wavelengths of 9.2 to 10.6 micrometers, is extremely useful because a $CO_2$ laser beam can be focused to vaporize and/or melt at least the back surface layer of the abrasive backing. Typically, multiple passes (traces) of the laser beam are made to complete each cut. The laser power and focusing is preferably adjusted to the laser scan speed and the thickness and energy absorption characteristics of the abrasive backing so that the laser does cut into the underlying abrasive material and to avoid any adverse ridging during the first past. The laser beam, as such, can be focused on the backside in a manner to only cut or score the, e.g., the back side, to a certain prescribed depth. This partial cut can be repeated until a clean cut through the abrasive article is created.

If an attachment layer is affixed to the backside of the abrasive article prior to laser cutting, ridge artifacts are lessened because of heat sink effects of the additional layer(s).

One specific example of a suitable pulse laser is as follows

Manufacture: Coherent Inc., of Santa Clara, Calif.

Model name: Diamond 84 Laser

Class: $CO_2$

Operating Wavelength: 10.6 μm

Max power at 60% Duty Cycle (@1 kHz): 300 w

Pulse energy range: 10-450 mJ

Pulse Width Range: 10-1000 μS

Pulse Rise and Fall time: <60 μS

Description: RF excited, sealed $CO_2$ Pulsed laser

Method of Delivery: Scanner Based

Input beam (Diameter) 7.0 mm

Final beam Diameter: 0.250 mm

| Pulse Width (mS) | Average Power (w) | Pulse Energy (J) | Exposure Energy (J/mm) | Peak Power (KW) | Duty Cycle (%) |
|---|---|---|---|---|---|
| 30 | 11.5 | 0.0115 | 0.046 | 0.38 | 3.0 |
| 37 | 15.65 | 0.0157 | 0.063 | 0.42 | 3.7 |
| 45 | 19.8 | 0.0198 | 0.079 | 0.44 | 4.5 |
| 52 | 24.3 | 0.0243 | 0.097 | 0.47 | 5.2 |
| 60 | 28.5 | 0.0285 | 0.114 | 0.475 | 6.0 |

One specific example of a suitable continuous wave laser is as follows

Manufacturer: Synrad, of Seattle, Wash.
Model Name: Evolution
Class: $CO_2$
Wavelength: 10.6 μm
Max power:
Continuous Mode: 100 w
Pulsed Mode: 150 W
Modulation: Up to 20 kHz
Rise Time: <150 μS
Description: RF excited, sealed $CO_2$ Pulsed laser to CW output
Method of Delivery: XY Plotter based
Input beam (Diameter) 4.0 mm
Final beam Diameter: 0.250 mm

| Repetition Rate | Laser % | Average Power | #Exposure Energy (J/mm) |
|---|---|---|---|
| 20 kHz | 20% | 38.9 w | 0.039 |
| 20 kHz | 15% | 33.3 w | 0.033 |
| 20 kHz | 10% | 24.8 w | 0.025 |
| 20 kHz | 65% | 84.0 w | 0.084 |

U.S. Pat. No. 6,826,204 provides an example of a super pulsed q-switch $CO_2$ laser that has a repetition rate of at least 100 kHz, with a wavelength ranging from 9.2 microns to 10.6 microns. It is believed that this laser, and others disclosed in this patent, would help with the edge effect noted in this disclosure. It is believed that these higher reputation rates would provide less of a recast layer and heat-affected zone by operating by more vaporization-dominated material removal rather than by melt-expulsion-dominated mechanisms.

Figure 5:
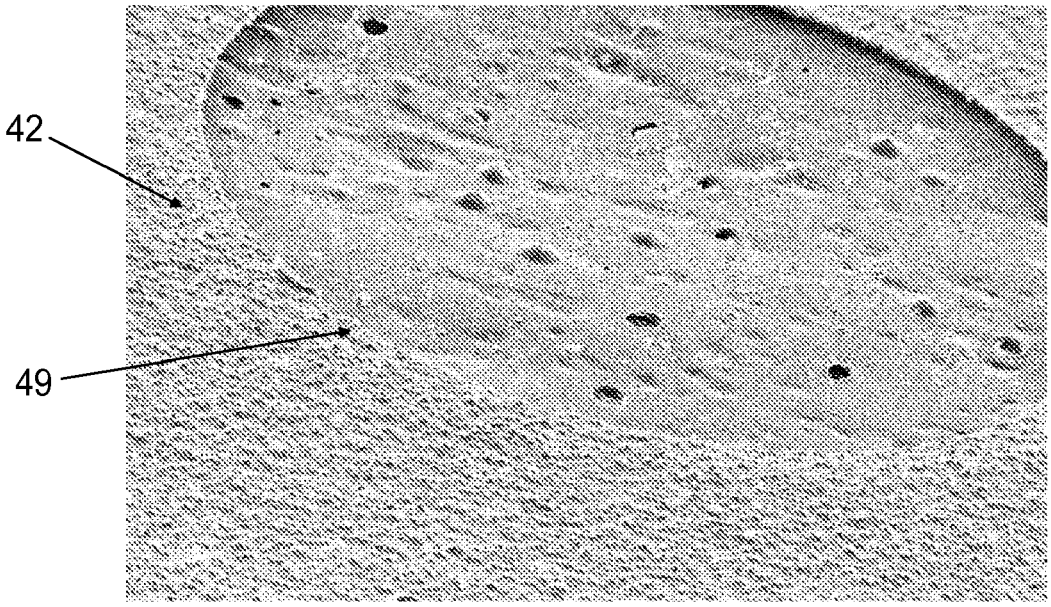
FIG. 5 is a close-up view of a photomicrograph of an internal aperture in an abrasive article, the internal aperture formed by a laser through the backside of the abrasive article.

FIG. 5 is a photomicrograph of a partial aperture in an abrasive article, the aperture having been cut by focused laser energy which was initiated through the side opposite the abrasive coating 42. It can be seen that the abrasive surface is generally flat with no ridge, protrusion, or other raised feature present proximate cut region 49 which defines the aperture. The abrasive surface remote from the aperture has a thickness that is unaffected by the laser converting. The edge of cut region 49 is fused by the laser energy directed thereon.

FIG. 6 is a photomicrograph of an aperture in an abrasive article, the aperture having been cut by focused laser energy which was initiated through the abrasive coating 42. A ridge 47 surrounds the aperture, forming an uneven abrasive coating surface. The height of ridge 47 immediately adjacent the aperture was about 165 micrometers greater than the abrasive coating 42 surface.

Figure 7:
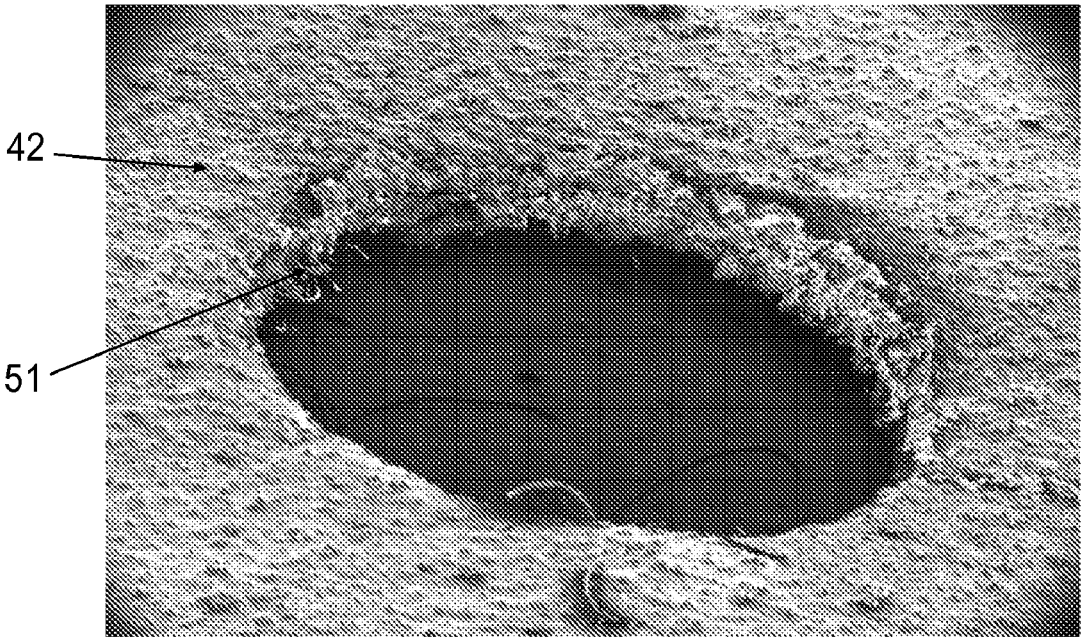
FIG. 7 is a close-up view of a photomicrograph of an aperture of a prior art abrasive article.

FIG. 7 is a photomicrograph of an aperture in a prior art abrasive article, which is believed to have been converted (e.g., cut) using a die cut. The aperture in the abrasive coating 42 has a side wall 51 with asperities formed by abrasive particles and backing structure.

It is theorized that the ridge (e.g., ridge 47 in FIG. 6) is formed by melted or otherwise distorted backing material and/or abrasive coating material. In some embodiments, e.g., a thermoplastic polymeric backing, the backing material may melt or distort, forming a ridge on the abrasive coating side. Even with non-thermoplastic polymeric backings (e,g., paper backings or cloth backings), a ridge is still encountered. For these abrasive articles with non-polymeric backings, it is a portion of the abrasive coating material, or other layer either above or below the abrasive coating, that may melt or distort, forming a ridge on the abrasive coating side.

An abrasive article as illustrated in FIG. 6, having, a ridge, is undesirable, at least because the ridges inhibit contact of the abrasive coating to the workpiece being abraded. Having less abrasive coating contacting the workpiece surface decreases the performance of the abrasive article, for example, by any or all of decreasing the cut rate of the workpiece, increasing the occurrence of scratches in the workpiece, and decreasing the life of the abrasive article.

EXAMPLES

1. Benefits of Cutting Through Back Side

Several abrasive articles were made using conventional make/size coating techniques. No supersize was present for these tests and no attachment system was present on the backing. The abrasive articles were converted into discs with internal apertures using a $CO_2$ laser.

Figure 8:
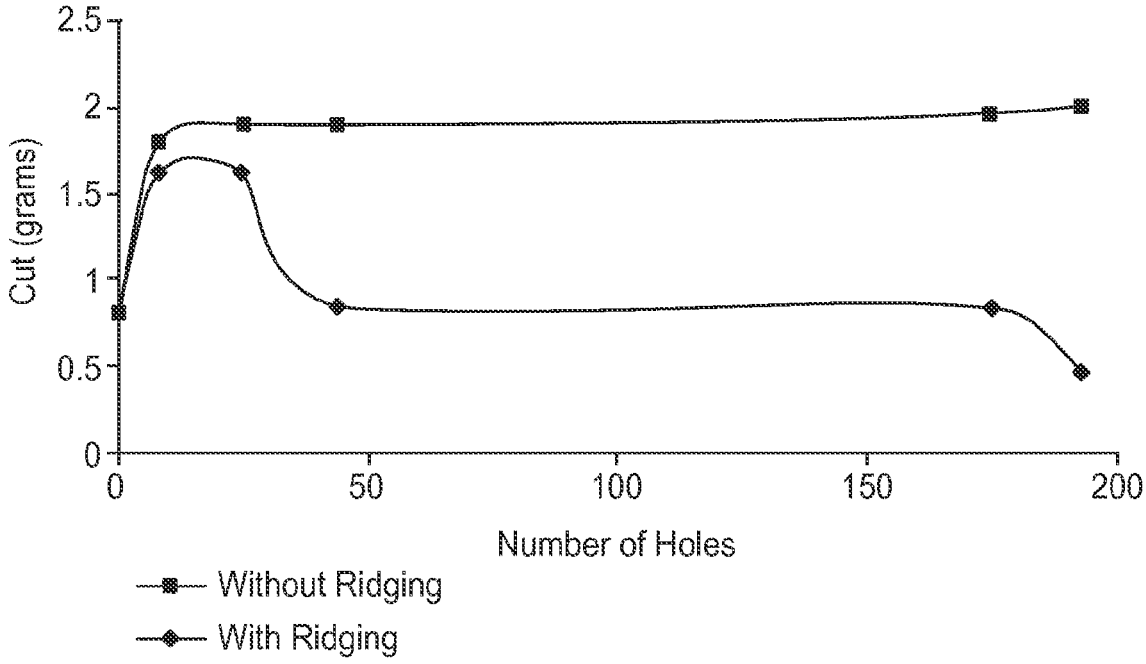
FIG. 8 is a graphical representation of cut results from the Examples, comparing abrasive articles made according to the invention of this disclosure and abrasive articles made by conventional methods.

For each test, one abrasive article was made using a $CO_2$ laser to cut internal apertures through the back side first (according to the invention of this disclosure) and one abrasive article was made using a laser to cut internal apertures through the front side (i.e., the abrasive coating side). Six different configurations of apertures were made. FIG. 8 shows of graph of performance results. The abrasive articles converted (e.g., cut) through the back side first did not have ridging whereas the abrasive articles cut through the front side first did have ridging.

It is seen in. FIG. 8 that for about 10 and more internal apertures, the cut rate was significantly less (i.e., about 0.8 grams) for the abrasive articles that were cut first through the abrasive coating as compared to the abrasive articles cut first through the back side (i.e., about 2 grams). It is theorized that the dramatic loss of performance was due to the high ridges surrounding each aperture, which do not allow the tips of the abrasive particles to contact and thus effectively abrade the workpiece surface.

2. Cutting Through Back Side in Presence of Adhesive on Backing

Several commercially abrasive articles ("360L" grade P800, from 3M Company) having conventional make/size coatings and no supersize coating were laminated to a dual-sided acrylic transfer tape ("3M 9695 5 mil Transfer Tape", from 3M Company) using the following procedure: A length of tape was unwound and cut from the main roil, exposing a bare surface of adhesive tape. Then the backside of an abrasive article, opposite the abrasive surface, was hand-laminated to the exposed, tacky surface of the tape. The laminated abrasive was perforated and cut into 5-inch diameter discs with a $CO_2$ laser through the back side (i.e., the transfer tape side). Comparative examples were cut through the front side (i.e., the abrasive side).

The abrasive articles cut through the back side first did not have ridging whereas the abrasive articles cut through the front side first did have ridging.

Next, several abrasive articles designated "373L" (which are identical to "372L" abrasive articles, available from 3M Company, St. Paul, Minn., except that the size coating thereon is colored), having abrasive particles of 15 to 200 micrometer, and also "360L", grades P220 to P1000, (also from 3M Company) having conventional make/size coatings and no supersize coating were laminated with an adhesive (identified below) using the conditions identified below.

| Abrasive Article | Adhesive and Type | Layers | Lamination Pressure | Lamination Temperature | Lamination Time |
|---|---|---|---|---|---|
| 3M 373L Grades 15 to 100 micron | "Bostik PO 104-30", polyolefin hotmelt 30 gm/yd2 | 4-6 | 2-5 psi | approx. 150° C. | 15-30 sec |
| 3M 373L Grades 15 to 100 micron | "Bostik PE 85-25", polyester hotmelt 25 gm/yd2 | 4-6 | 2-5 psi | approx. 150° C. | 15-30 sec |
| 3M 373L and 360L Grades P220 to P1000 | "3M 964" (with a paper liner), 13 mil thick acrylic PSA tape | 1 | 1-2 psi (hand pressure) | 25° C. (room temp) | 2-10 sec. |
| 3M 373L and 360L Grades P220 to P1000 | "3M 9695" (with a paper liner), 5 mil thick acrylic PSA tape | 1 | 1-2 psi (hand pressure) | 25° C. (room temp) | 2-10 sec. |

The adhesive was laminated to the backside of an abrasive article, apposite the abrasive surface. The laminated abrasive was perforated and cut into 5-inch diameter discs with a $CO_2$ laser through the back side (i.e., the adhesive side). Comparative examples were cut through the front side, (i.e., the abrasive side).

The abrasive articles cut through the back side first did not have ridging whereas the abrasive articles cut through the front side first did have ridging.

3. Application of Supersize Coating After Cutting

Several commercially abrasive articles ("360L" grade P800, from 3M Company) having conventional make/size coatings and no supersize coating were used as the basis for the following test. For Example 1, the standard abrasive article, having no internal holes, was used. For Example 2, a zinc stearate supersize coating was applied to an abrasive article having no internal holes. For Example 3, internal vacuum holes were laser cut, through the back side, of an abrasive article having a zinc stearate supersize coating. For Example 4, internal vacuum holes were laser cut, through the back side, of an abrasive article, after which a zinc stearate supersize coating was applied.

The four examples were tested by the following procedure. The abrasive, article was attached to a "Dynabrade" 5 inch back-up pad having 40 vacuum holes therein. A 40 hole "Dynabrade" 5 inch interface pad was also used. The back-up pad and abrasive article were attached to a "Dynabrade" 6 inch, pneumatic, self generated vacuum sander; the sander was operated at 90 psi air pressure. A clear coated test panel (from ACT Laboratories, "RK148") was sanded for 30 seconds with the abrasive article.

The weight of the panel, both before sanding and after the 30 second sanding, was recorded. The difference was the "cut". Additionally, the time to form the first scratch (i.e., "Q") was recorded.

| Example | cut | Time to Q |
|---|---|---|
| 1 | 0.22 g | 8 seconds |
| 2 | 0.38 g | 8 seconds |
| 3 | 0.37 g | 8 seconds |
| 4 | 0.57 g | 24 seconds |

These results show that applying the supersize coating after converting with the laser provides better cut rate and a longer time duration to scratching.

The above specification and examples are believed to provide a complete description of the manufacture and use of particular embodiments of the invention. Because many embodiments of the invention can be made without departing from the spirit and scope of the invention, the true scope and spirit of the invention reside in the broad meaning of the claims hereinafter appended.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this disclosure.

What is claimed is:

1. An abrasive article comprising:

(a) a backing having an abrasive coating on a first side of the backing, the abrasive coating comprising abrasive particles less than 40 micrometers; and (b) greater than about 40 apertures through the backing and the abrasive coating, each aperture having a sidewall; and wherein the sidewall is fused and a ridge of recast material extends no more than 10 micrometers above the abrasive coating.

2. The abrasive article of claim 1 comprising at least 100 apertures.

3. The abrasive article of claim 1, comprising a central region having randomly placed apertures and an annular outer region having a plurality of apertures arrayed along a radial arc.

4. The abrasive article of claim 1, wherein the abrasive coating comprises abrasive particles having a size less than 35 micrometers.

5. The abrasive article of claim 1 wherein the ridge of recast material extends no more than 5 micrometers above the abrasive coating.

6. The abrasive article of claim 1 wherein the fused sidewall is formed by cutting the at least one aperture in the abrasive article by focusing laser energy on the backing, with the laser energy passing through the backing prior to passing through the abrasive coating.

7. The abrasive article of claim 1 wherein a supersize coating is coextensive with the sidewall of the aperture.

8. The abrasive article of claim 7 wherein the supersize coating is applied to the abrasive article after cutting the at least one aperture in the abrasive article by focusing laser energy on the backing, with the laser energy passing through the backing prior to passing through the abrasive coating.

* * * * *

UNITED STATES PATENT AND TRADEMARK OFFICE

CERTIFICATE OF CORRECTION

PATENT NO. : 7,959,694 B2
APPLICATION NO. : 11/781573
DATED : June 14, 2011
INVENTOR(S) : Ehrich J Braunschweig It is certified that error appears in the above-identified patent and that said Letters Patent is hereby corrected as shown below:

Column 1
Line 26, delete "of" and insert -- or --, therefor.

Column 2
Line 15, delete ""maybe" and insert -- may be --, therefor.

Column 3
Line 26, delete "coal" and insert -- coat --, therefor.

Column 6
Line 37, delete "tree" and insert -- free --, therefor.

Column 7
Line 7, delete "fool" and insert -- tool --, therefor.
Line 14, delete "5,433,816," and insert -- 5,435,816, --, therefor.

Column 8
Line 9, delete "s" and insert -- a --, therefor.
Line 31, delete "FIG, 4b," and insert -- FIG. 4b, --, therefor.

Column 9
Line 26, delete "(e,g.," and insert -- (e.g., --, therefor.
Line 38, delete ""lasers"(i.e.," and insert -- "lasers" (i.e., --, therefor.
Line 53, delete "easy" and insert -- easy, --, therefor.

Column 10
Line 42, delete "Manufacture:" and insert -- Manufacturer: --, therefor.

Signed and Sealed this
Sixteenth Day of August, 2011

David J. Kappos

David J. Kappos
*Director of the United States Patent and Trademark Office*

Column 11
Line 62, delete "(e,g.," and insert -- (e.g., --, therefor.

Column 12
Line 1, delete "having," and insert -- having --, therefor.
Line 31, delete "in." and insert -- in --, therefor.
Line 49, delete "roil," and insert -- roll, --, therefor.

Column 13
Line 19, delete "apposite" and insert -- opposite --, therefor.
Line 22, delete "side," and insert -- side --, therefor.
Line 41, delete "abrasive," and insert -- abrasive --, therefor.